United States Patent [19]

Castonguay et al.

[11] Patent Number: 4,733,211

[45] Date of Patent: Mar. 22, 1988

[54] MOLDED CASE CIRCUIT BREAKER CROSSBAR ASSEMBLY

[75] Inventors: Roger N. Castonguay, Terryville; David Arnold, Old Saybrook; David J. Meiners, Southington, all of Conn.

[73] Assignee: General Electric Company, New York, N.Y.

[21] Appl. No.: 3,002

[22] Filed: Jan. 13, 1987

[51] Int. Cl.[4] ..... H01H 3/00

[52] U.S. Cl. ..... 335/192; 335/189; 335/16; 335/195

[58] Field of Search ..... 335/8-10, 335/6, 23, 35, 189, 190, 191, 193, 195, 16, 192, 194, 147, 185

[56] References Cited

U.S. PATENT DOCUMENTS 4,567,455 1/1986 Hosogai et al. ..... 335/195

OTHER PUBLICATIONS

U.S. patent application Ser. No. 817,213, filed Jan. 8, 1986, entitled "Interchangeable Mechanism For Molded Case Circuit Breaker", in the names of Ronald D. Ciarcia et al.

*Primary Examiner*—E. A. Goldberg
*Assistant Examiner*—Lincoln Donovan
*Attorney, Agent, or Firm*—Richard A. Menelly; Walter C. Bernkopf; Fred Jacob

[57] ABSTRACT

A molded case circuit breaker crossbar assembly allows the movable contact carrier, contact spring and contact carrier operating cam to be preassembled prior to insertion within the circuit breaker case. The crossbar is fabricated from a plastic molding composition having means thereon for supporting the movable contact carrier and for retaining the charged contact operating spring. The contact carrier operating cam engages a roller carried by the operating mechanism link to couple the crossbar assembly to the circuit breaker operating mechanism.

20 Claims, 8 Drawing Figures

Fig.3.
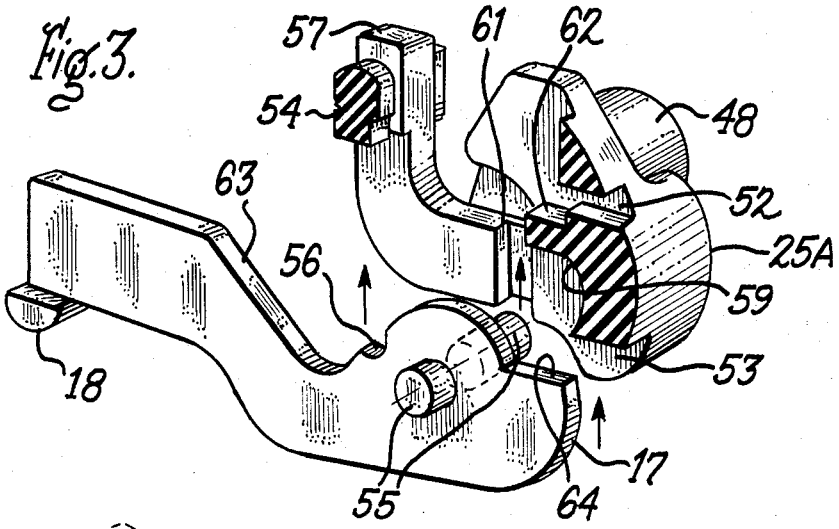
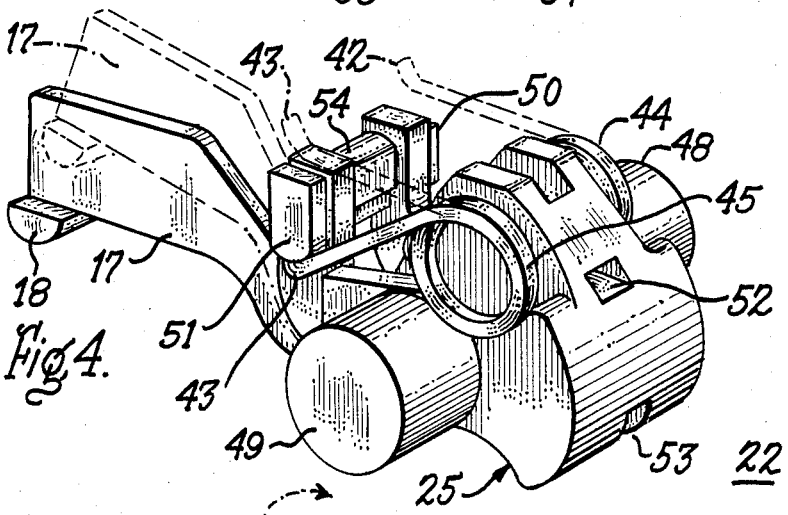
Fig.4.
Fig.5.
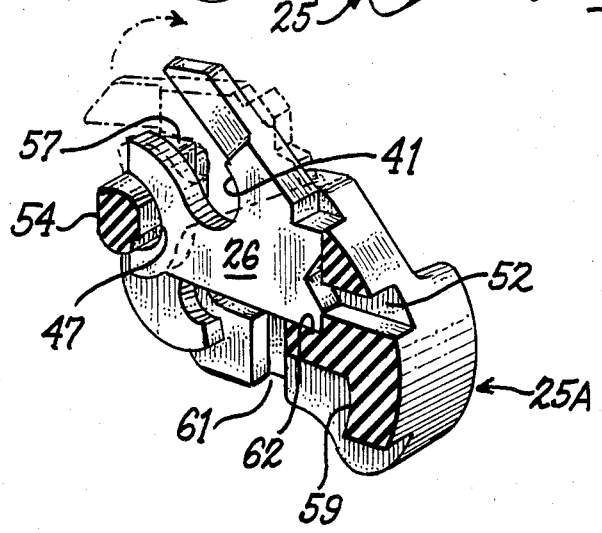

MOLDED CASE CIRCUIT BREAKER CROSSBAR ASSEMBLY

BACKGROUND OF THE INVENTION

Earlier attempts at complete automation of industrial type molded case circuit breakers have not heretofore been feasibly successful. One of the problems interfering with the robotic assembly of the circuit breaker components is the attachment of the movable contact arm or carrier and contact spring to the crossbar assembly. The robotic assembly of the circuit breaker components can be greatly simplified by preassembling the carrier and contact spring to the crossbar prior to insertion within the circuit breaker case. One difficulty that occurs when assembling the contact spring to the crossbar, however, is the "loading" of the contact spring to bias the carrier in a set position relative to the crossbar. "Preloading" the contact spring in a simplified manner would beneficially allow robotic assembly of the crossbar assembly within the circuit breaker case. One purpose of the instant invention, therefore, is to provide a crossbar assembly containing a preloaded contact spring which can be completely pre-assembled by automated means prior to insertion within the circuit breaker case.

SUMMARY OF THE INVENTION

A circuit breaker molded plastic slotted crossbar assembly contains a molded plastic crossbar having detent projections integrally formed within a unitary structure. The movable contact carrier is first assembled to the crossbar. The contact spring is next placed on the crossbar with the crossover loop of the contact spring positioned within a groove in the movable contact carrier. Rotation of the contact spring on the crossbar traps the ends of the contact spring under detent projections formed within the crossbar and locks the contact carrier to the crossbar. The contact carrier operating cam is then positioned on the crossbar after which the complete crossbar assembly is inserted within the circuit breaker case. The slotted portion of the crossbar is configured to allow the carrier captured in the crossbar to be plugged onto the pivot stab assembly previously arranged within the circuit breaker case.

BRIEF DESCRIPTION OF THE DRAWINGS

FIG. 3 is a side perspective view, in partial section, of the crossbar assembly depicted in FIG. 1 illustrating the loading of the contact carrier to the crossbar;

FIG. 4 is a side perspective view of the crossbar assembly of FIG. 1 illustrating the loading of the contact spring to the contact carrier;

FIG. 5 is a top perspective view, in partial section, of the crossbar assembly of FIG. 1 illustrating the loading of the movable contact carrier cam to the crossbar;

DESCRIPTION OF THE PREFERRED EMBODIMENT

Figure 1:
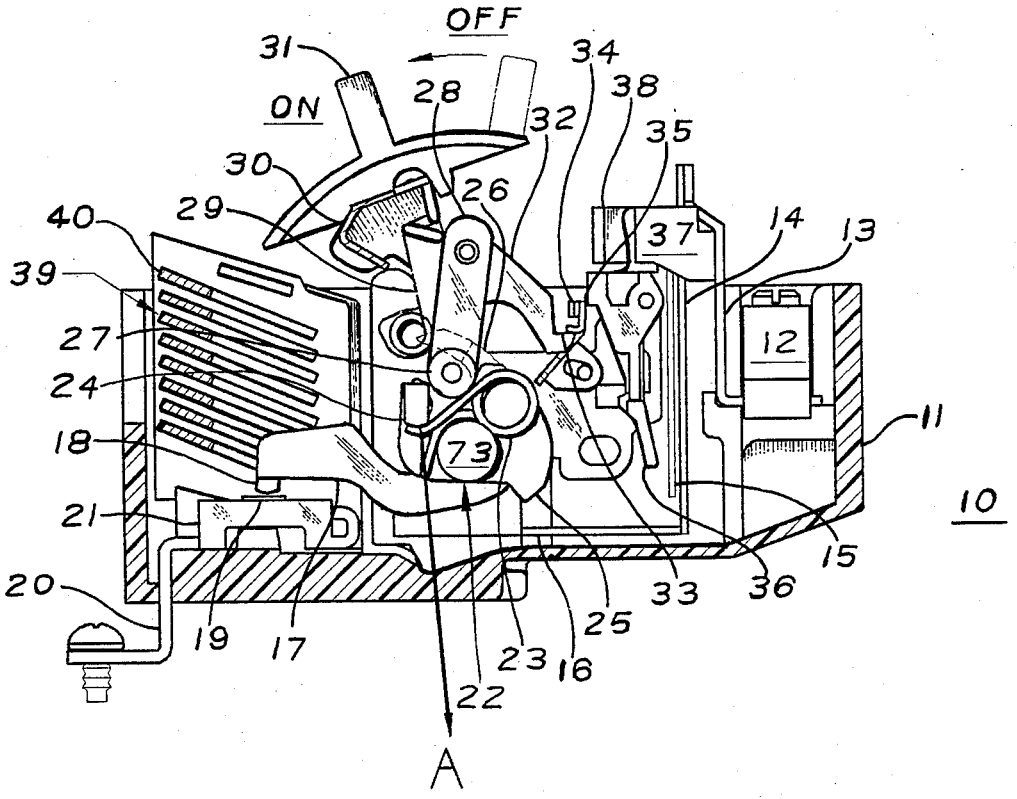
FIG. 1 is a side view, in partial section, of a molded case circuit breaker case containing the crossbar assembly according to the invention.

A molded case circuit breaker used within industrial lighting panelboards is shown at 10 in FIG. 1. Case 11, shown with the cover removed, supports a load terminal lug 12 at one end, which electrically connects through a load strap 13, heater 14 and stab-conductor 16 to the movable contact arm or carrier 17. The circuit is completed through the movable contact 18 and fixed contact 19 to the line strap 20 through the stationary contact support 21. A crossbar assembly 22 supports a contact spring 23 on the molded plastic crossbar 25 and retains the legs of the contact spring under a pair of projections integrally formed within the crossbar, one of which is depicted at 24. The arrangement of the contact carrier with the crossbar assembly is defined herein as the "contact carrier assembly" 73. Although the crossbar assembly 22 is depicted for a single pole circuit breaker, it is to be clearly understood that a similar arrangement is used within multi-pole circuit breakers with additional operating components for each additional pole. The crossbar assembly 22 connects with the operating cradle link 28 by means of a movable contact operating cam 26, which captures a roller 27 attached to the bottom of the link. A pair of operating springs 29 are arranged on opposite sides of the operating cradle 32 and connect between the bottom of the link 28 and the handle yoke 30. One of the springs is removed to more clearly show the arrangement between the movable contact operating cam and the roller. The operating springs are moved overcenter to the "ON" condition by movement of the operating handle 31 from its "OFF" position, as indicated. The cradle link 28, operating springs 29 and the operating cradle 32 form what is defined herein as the "operating mechanism", which provides the force required to lift the movable contact carrier and separate the movable contact 18 from the fixed contact 19 to interrupt circuit current through the breaker. The operating cradle 32 prevents the operating springs from snappingly lifting the movable contact arm by the engagement of the cradle hook 33 with a primary latch 34, as indicated. The primary latch, in turn, is retained by a secondary latch 35 in close proximity to the trip bar 36. Upon the occurrence of short-term overcurrent conditions, a magnet 37 draws a pivotally mounted armature 38 into contact with the trip bar 36, causing the secondary latch to move away and thereby allow the primary latch to release the cradle hook. Upon the occurrence of long-term overcurrent conditions, the bimetal 15 moves away from the heater 14 and contacts the trip bar 36 in a similar manner. When the contacts 18, 19 are separated under such overcurrent conditions, an arc occurs which is immediately motivated within the arc chute 39 and is extinguished by contacting the arc plates 40. A good explanation of the operation of the circuit breaker under overcurrent conditions is found within U.S. patent application Ser. No. 817,213, filed Jan. 8, 1986, in the names of Ciarcia et al, which Application is incorporated herein for purposes of reference.

Figure 2:
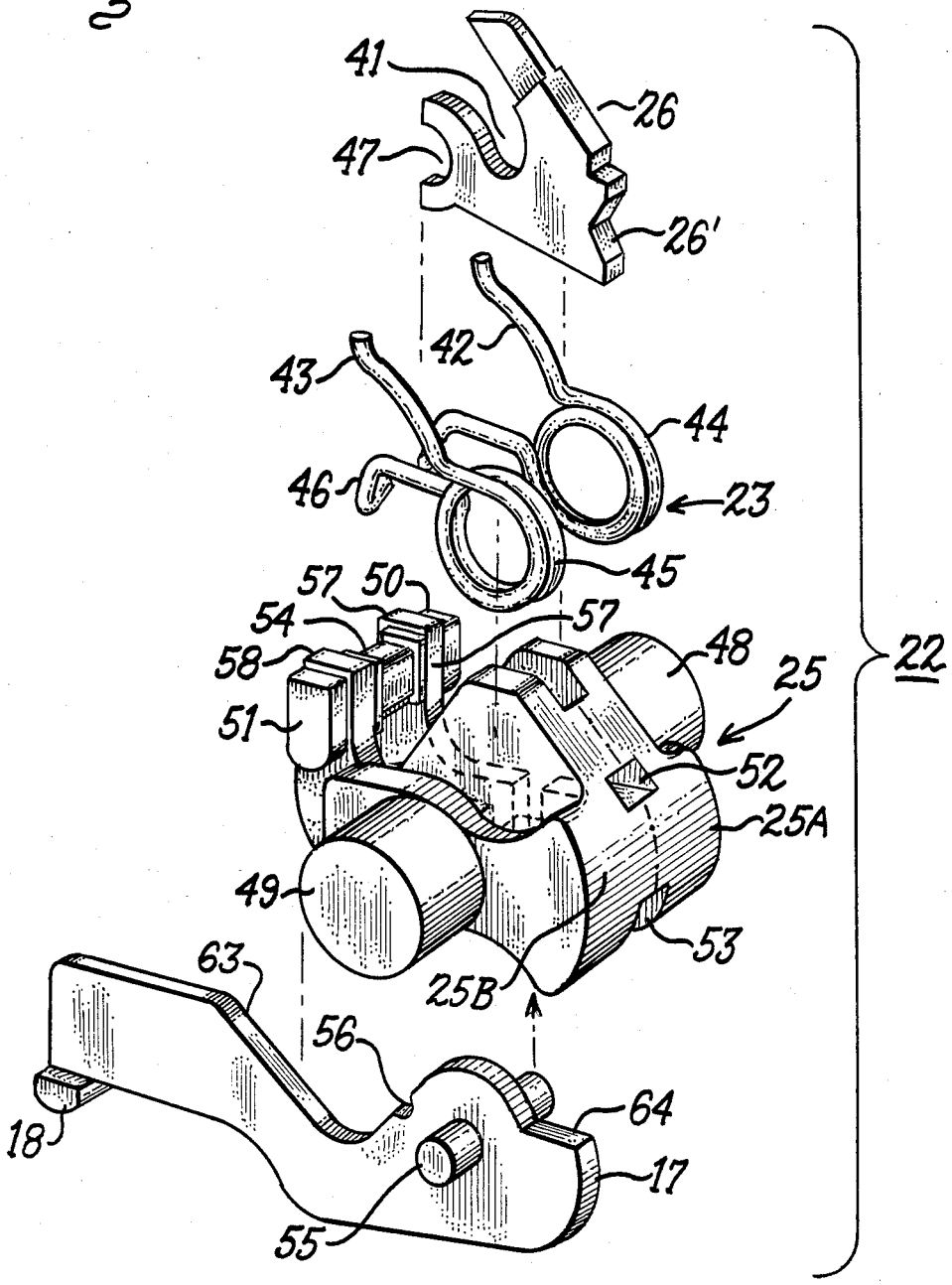
FIG. 2 is a top perspective view, in isometric projection, of the components comprising the crossbar assembly.

The crossbar assembly components are shown in FIG. 2 prior to assembly. The movable contact carrier 17 contains a pivot post 55, which extends from both sides of the carrier at an end of the carrier opposite the movable contact 18. A clearance groove 63 is formed within the top surface of the carrier along with a contact spring retainer groove 56 and an opening 52 is formed within the rear of the top surface for purposes which will be described below. The crossbar is made from a single plastic injection molding, but is designated in phantom as consisting of pieces 25A, 25B for purposes of description only. The carrier is first inserted within the crossbar 25 by fitting the carrier clearance groove 63 within the clearance slot 53 formed within the bottom of the crossbar. At the same time, the pivot post 55 fits within the pivot slot 61, as best seen in FIG. 3. An opposite and complementary pivot slot, although not shown, is formed within the other opposing surface of the opposite crossbar piece 25B.

Figure 7:
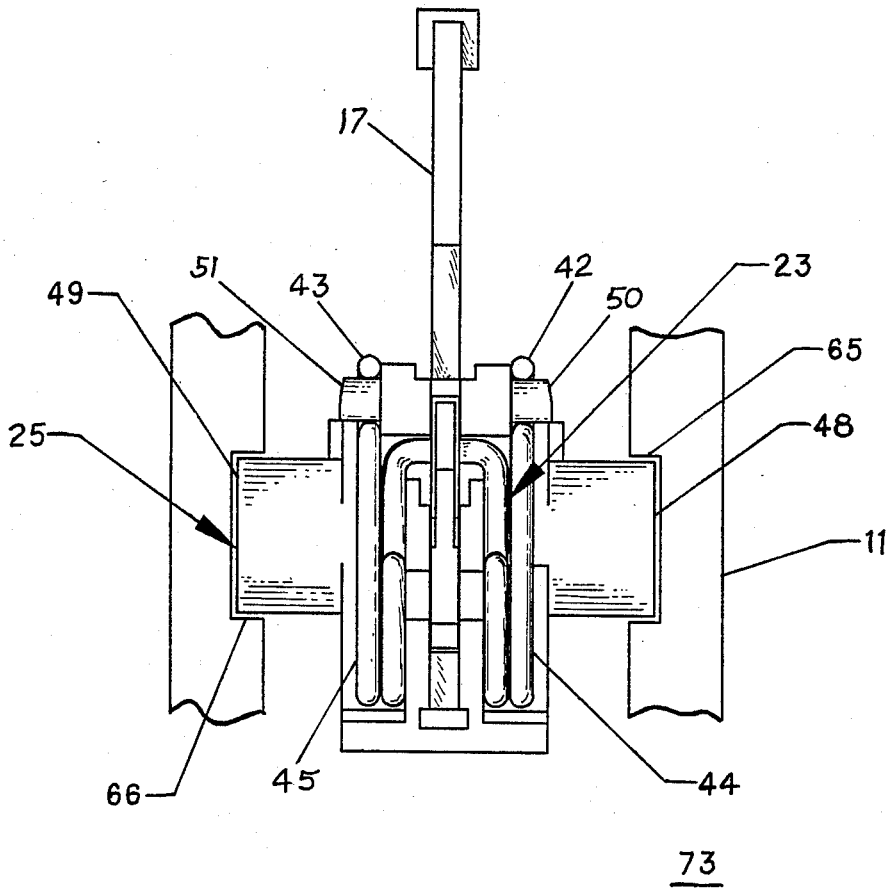
FIG. 7 is a top plan view, in partial section, of the completed crossbar assembly according to the invention.

Referring back to FIG. 2, with the carrier inserted in the crossbar slot, the contact spring 23 is then downloaded onto the crossbar by first positioning the spring crossarm 46 formed between the first and second spring coils 44, 45 within the contact spring groove 56 formed within the carrier and then expanding the spring legs 42, 43 outwardly away from each other and positioning them under the complementary detents 50, 51 on the crossbar arms 57, 58 to "charge" the contact spring. The crossbar is integrally formed from a plastic injection molding process wherein a pair of cylinders 48, 49 extend outboard the crossbar for fitting within complementary grooves 65, 66 integrally formed within the circuit breaker case, and which enable the crossbar assembly to rotate as a unit, as best seen in FIG. 7. Now referring back to FIGS. 3 and 5, the posts 57, 58 extend from a forward surface of the crossbar with a forward contact carrier stop 54 extending between their inner surfaces, as indicated. A surface projection 59 is formed on the rear of the crossbar, serving as a rear stop for the step 64 formed on the rear surface of the carrier. Although not shown, a similar surface projection is formed on the opposite rear surface of the opposite crossbar piece 25B. The forward stop 54 limits the clockwise direction of travel of the carrier, which is governed by the radius of the clearance groove 63 while the surface projection 59 limits the counterclockwise direction of travel of the carrier.

Figure 8:
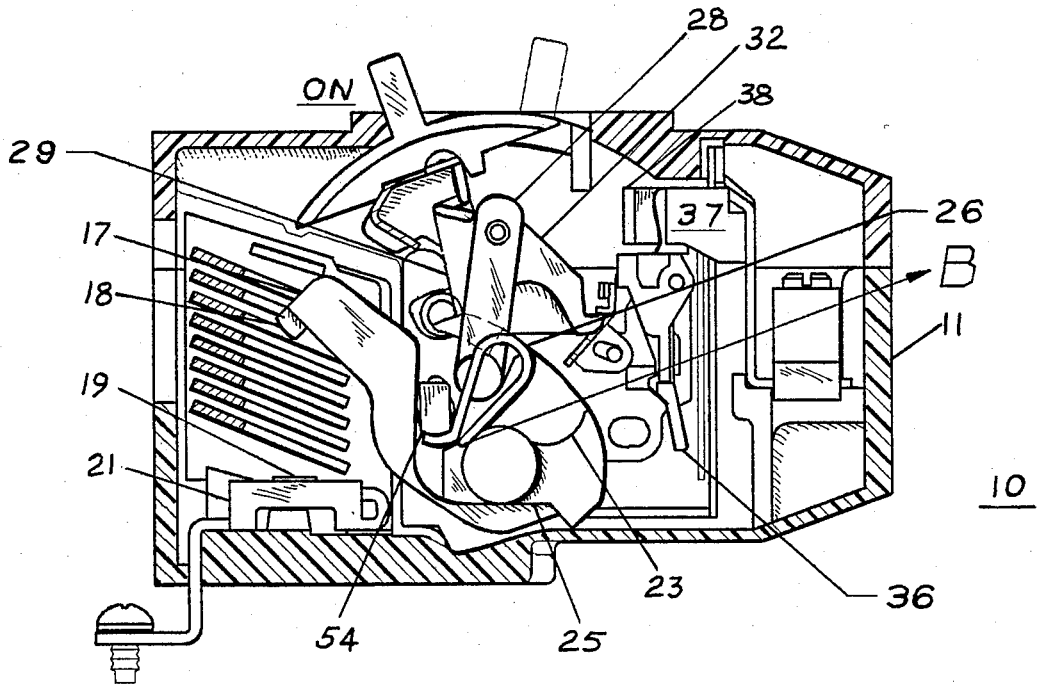
FIG. 8 is a side view, in partial section, of the circuit breaker of FIG. 1 with the movable contact carrier depicted in a "blown-open" condition.

As shown in FIG. 4, the contact spring 23 is depicted in phantom prior to positioning the first and second spring legs 42, 43 under the respective detents 50, 51 and is indicated in full lines with the spring legs arranged beneath the detents. The positioning of the spring legs under the detents rotates the carrier in the counterclockwise direction, as indicated, and tensions or "charges" the contact spring and holds the arm and the contact in a "set" condition relative to the crossbar. The force vector generated by the contact spring acting on the carrier, when the carrier is in its "closed" position, is indicated in the A direction in FIG. 1. When the carrier moves to its "blown-open" position, as indicated in FIG. 8, the force vector acting on the carrier moves to the B direction, which is the overcenter position for the contact spring. The overcentering of the contact spring holds the carrier against the stop 54, as described earlier. This is an important feature of the invention, since the movable contact separates from the fixed contact upon the occurrence of a short circuit overcurrent condition and become electrodynamically repulsed, driving the carrier to its "blown-open" position before the operating mechanism can respond. The overcenter condition of the contact spring inhibits the counterclockwise return of the carrier and thereby prevents the carrier from injuriously bouncing back away from the stop. This allows the circuit breaker magnetic trip unit to then respond, as described earlier with reference to FIG. 1, and rotate the crossbar to its "OPEN" condition. The so-called "blown-open" condition of the circuit breaker is depicted in FIG. 8 wherein the carrier 17 moves to its "OPEN" position before the magnet 37 has had sufficient time to attract the armature 38 against the trip bar 36, causing the operating mechanism to respond by articulating the operating cradle 32 and thereby moving the crossbar to its "OPEN" condition.

Figure 6:
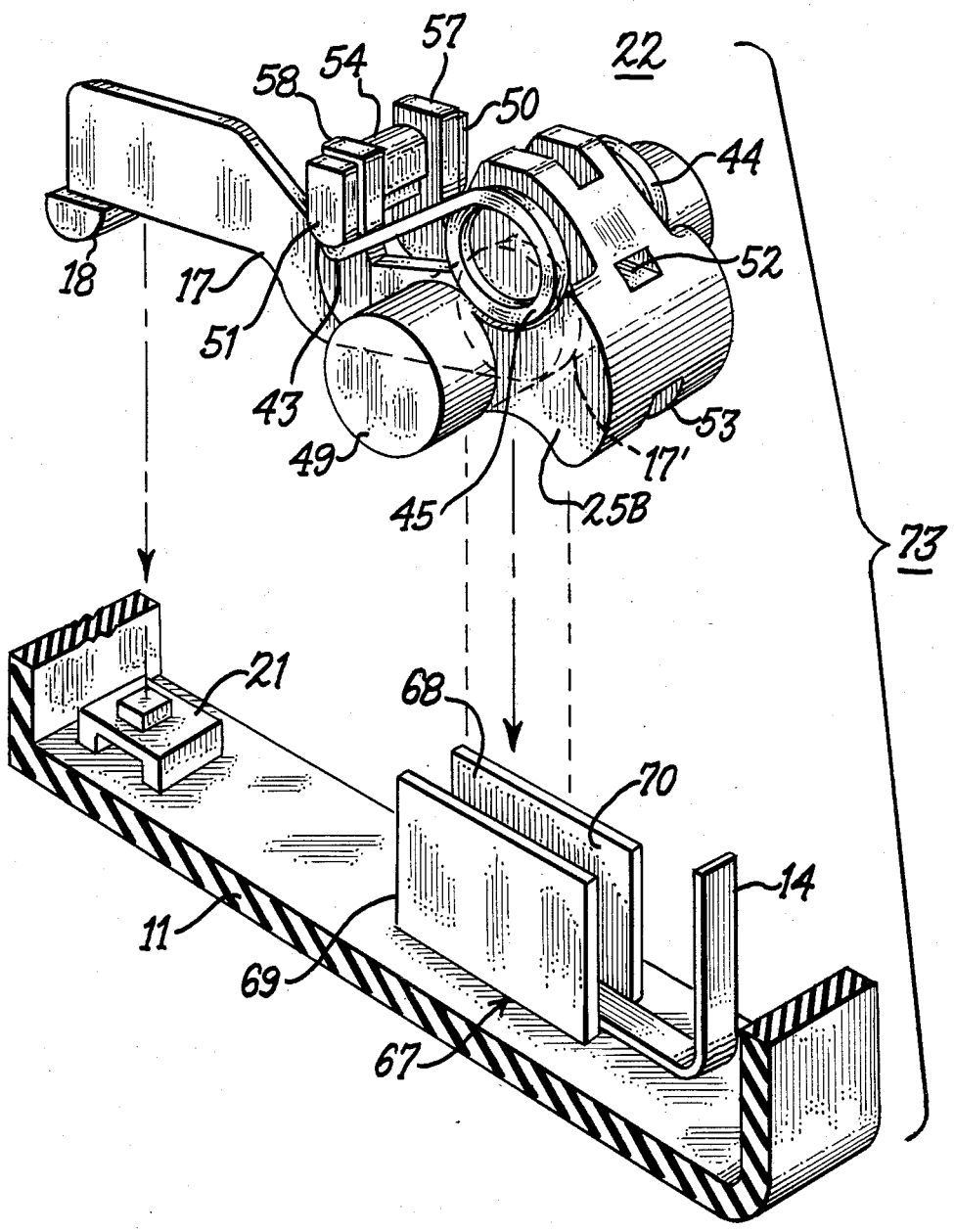
FIG. 6 is a side perspective view of the crossbar assembly in isometric projection from the circuit breaker case, shown in partial section.

The operating cam 26 shown in FIGS. 2 and 5 is formed from a single shaped piece of steel. An elongated curvilinear slot 41 is formed within the cam extending inward from one end. An arcuate yoke 47 is formed on the same side as the curvilinear slot opening and serves to pivotally mount the cam to the crossbar. The positioning of the cam on the crossbar is best seen in FIG. 5, wherein the cam is indicated in phantom with the yoke first encompassing the stop 54 formed as shown in the crossbar piece 25A, whereafter the cam is rotated in the clockwise direction such that the bottom of the cam seats on a step 62 integrally formed within the crossbar. The cam is then locked in position by inserting a pin (not shown) or other fastening means through the opening 52 formed in the crossbar into engagement with the step 26' formed within the rear surface of the cam, as best seen in FIG. 2. The roller 27 of FIG. 1, trapped within the elongated curvilinear slot 41, drives the crossbar and the carrier to the "OPEN" and "CLOSED" positions by movement of the operating mechanism in response to the movement of the operating handle, as described earlier. Once the crossbar assembly components are completely assembled, the entire crossbar assembly 22 is automatically loaded onto the contact carrier support 67 to form the complete contact carrier assembly 73 in the manner depicted in FIG. 6. The contact carrier support is fully described within U.S. patent application Ser. No. 941,974 filed 12-15-86, which application is incorporated herein for reference purposes. For purposes of clarity, only the portion of the circuit breaker case 11 which supports the stationary contact support 21 and the contact carrier support 67 with the conductor 16 and heater 14 attached are illustrated herein. The rear 17' of the contact carrier is inserted within the opening 70 defined between the two upstanding arms 68, 69 of the carrier support. The downward loading of the crossbar assembly by the automatic assembly means is an important feature of the instant invention.

The complete contact carrier assembly 73 is shown in FIG. 7, wherein the carrier 17 is retained within the crossbar 25 by trapping the spring legs 42, 43 under the detents 50, 51 integrally formed within the crossbar with the contact spring 23 in its "loaded" condition and with the first and second spring coils 44, 45 extending above the top surface of the crossbar. This allows the crossbar assembly 22 to be downloaded within the circuit breaker case by automatically inserting the cylinders 48, 49 integrally formed in the crossbar within the grooves 65, 66, integrally formed within the case as described earlier.

It has thus been shown that an integrally formed plastic crossbar assembly retains the movable contact carrier, contact spring and operating cam as a unitary assembly. The unique arrangement of the contact spring within the crossbar assembly allows the contact carrier to remain in the "OPEN" condition upon short circuit conditions without rebounding and damaging the circuit breaker contacts.

Having thus described our invention, what we claim as new and desire to secure by Letters Patent is:

1. A molded case circuit breaker crossbar assembly comprising:

a plastic crossbar body member including a pair of spaced parallel upstanding arms integrally formed therein;

a stop member extending across an end of each of said crossbar arms;

detent means integrally formed on each of said crossbar arms outboard said stop member;

first slot means formed on a bottom surface of said crossbar member;

a movable contact carrier having a movable contact on one end and a pivot post extending through said carrier at an opposite end, said contact carrier being inserted within said first slot means;

a contact spring mounted on a top surface of said crossbar member and comprising a pair of spring coils joined by a crossover arm, said spring further including a pair of legs, each of said spring legs extending from one of said spring coils;

a circuit breaker operating mechanism for lifting said movable contact carrier upon overcurrent conditions through said movable contact; and an operating cam supported on said crossbar member and engaging a roller connected with said operating mechanism.

2. The molded case circuit breaker crossbar assembly of claim 1 wherein said stop member comprises a cylinder.

3. The molded case circuit breaker crossbar assembly of claim 1 wherein said detents comprise a pair of rectangular extensions.

4. The molded case circuit breaker crossbar assembly of claim 1 wherein said contact carrier includes a clearance groove formed within a top surface.

5. The molded case circuit breaker crossbar assembly of claim 1 further including a spring retainer groove formed within said contact carrier top surface.

6. The molded case circuit breaker crossbar assembly of claim 5 wherein said contact spring crossover arm is retained within said contact carrier retainer groove.

7. The molded case circuit breaker crossbar assembly of claim 3 wherein said spring legs are retained by said rectangular extensions.

8. The molded case circuit breaker crossbar assembly of claim 1 wherein said operating cam comprises a shaped metal member defining both an elongated curvilinear slot and an arcuate yoke on one end.

9. The molded case circuit breaker crossbar assembly of claim 8 wherein said operating cam elongated slot captures said operating mechanism roller.

10. The molded case circuit breaker crossbar assembly of claim 8 wherein said operating cam arcuate yoke encompasses a part of said stop member.

11. The molded case circuit breaker crossbar assembly of claim 5 wherein said spring crossover arm prevents said contact carrier from moving out of said first crossbar slot.

12. The molded case circuit breaker crossbar assembly of claim 1 including a second slot formed within said crossbar, said pivot post being inserted within said second slot.

13. The molded case circuit breaker crossbar assembly of claim 1 including a metal contact carrier support within a circuit breaker case, said crossbar member being inserted over said contact carrier support by capturing said contact carrier support within said first crossbar slot.

14. The molded case circuit breaker crossbar assembly of claim 13 wherein said contact carrier support includes a pair of spaced parallel posts and wherein said contact carrier is inserted between said spaced parallel posts.

15. A molded case circuit breaker crossbar assembly comprising:

a slotted molded plastic crossbar having cylindrical extension means for pivotal motion within a circuit breaker enclosure;

a movable contact carrier pivotally arranged within said crossbar slot and having a movable contact at one end;

a contact spring comprising a pair of spring coils joined by a crossover arm and a pair of spring legs, each of said legs extending from one of said spring coils, said contact spring biasing said movable contact carrier in a first location when the circuit breaker is in a closed position;

a pair of detent means integrally formed on a pair of legs exending from said crossbar; and a retainer groove within a top surface of said contact carrier, said spring crossover arm being supported within said retainer groove and said spring legs being retained by said detent means;

means wherein said contact spring legs move from said first location to a second location when said movable contact carrier is in an open contact position and said contact spring holds said movable contact carrier in said open contact position.

16. The molded case circuit breaker crossbar assembly of claim 15 wherein said contact spring second location is overcenter.

17. The molded case circuit breaker crossbar assembly of claim 15 wherein said crossbar includes a pair of integrally formed arms extending parallel to each other.

18. The molded case circuit breaker crossbar assembly of claim 16 including a cylindrical stop member extending between said pair of arms, said movable contact carrier striking said stop member when said movable contact carrier moves to said open contact position.

19. The molded case circuit breaker crossbar assembly of claim 15 including an operating cam mounted on said crossbar, said operating cam comprising a shaped metal member having both an elongated curvilinear slot and an arcuate yoke formed within one end.

20. The molded case circuit breaker crossbar assembly of claim 19 wherein said operating cam yoke encompasses a pair of said stop member.

* * * * *